US005845399A

United States Patent [19]

Dewar et al.

[11] Patent Number: 5,845,399

[45] Date of Patent: Dec. 8, 1998

[54] COMPOSITE PLATE PIN OR RIBBON HEAT EXCHANGER

[75] Inventors: Douglas M. Dewar, Rolling Hills Estates; Christopher K. Duncan, Long Beach; Alexander F. Anderson, Rolling Hills Estates, all of Calif.

[73] Assignee: AlliedSignal Inc., Morris Township, N.J.

[21] Appl. No.: 712,003

[22] Filed: Sep. 9, 1996

Related U.S. Application Data

[62] Division of Ser. No. 463,609, Jun. 5, 1995.

[51] Int. Cl.[6] ..... F28D 9/02; F28D 9/00

[52] U.S. Cl. ..... 29/890.03; 165/166; 165/185; 165/905; 165/DIG. 356

[58] Field of Search ..... 165/166, 185, 165/905, DIG. 356; 29/890.03

[56] References Cited

U.S. PATENT DOCUMENTS

| | | | |
|---|---|---|---|
| T911,013 | 6/1973 | Morgans et al. . | |
| 1,662,870 | 3/1928 | Stancliffe . | |
| 2,825,688 | 3/1958 | Vernon . | |
| 2,892,618 | 6/1959 | Holm | 165/185 |
| 3,389,964 | 6/1968 | Olstowski . | |
| 3,394,887 | 7/1968 | Megargle et al. . | |
| 3,448,181 | 6/1969 | Olstrowski et al. . | |
| 3,492,197 | 1/1970 | Olstrowski et al. . | |
| 3,524,497 | 8/1970 | Chu et al. | 165/185 X |
| 3,542,124 | 11/1970 | Manfredo et al. . | |
| 3,595,029 | 7/1971 | Lende . | |
| 3,627,551 | 12/1971 | Olstowski . | |
| 3,854,186 | 12/1974 | Sergeys . | |
| 4,017,347 | 4/1977 | Cleveland . | |
| 4,263,966 | 4/1981 | Ostbo . | |
| 4,263,967 | 4/1981 | McNab et al. . | |
| 4,362,209 | 12/1982 | Cleveland . | |
| 4,432,408 | 2/1984 | Caines . | |
| 4,434,845 | 3/1984 | Steeb . | |
| 4,473,111 | 9/1984 | Steeb . | |
| 4,494,597 | 1/1985 | Fukami et al. . | |
| 4,577,678 | 3/1986 | Frauenfeld et al. . | |
| 4,615,379 | 10/1986 | Künzel . | |
| 4,771,826 | 9/1988 | Grehier et al. . | |
| 4,832,118 | 5/1989 | Scanlon et al. . | |
| 4,858,685 | 8/1989 | Szücs et al. . | |
| 4,934,455 | 6/1990 | Hasegawa . | |
| 5,025,856 | 6/1991 | VanDyke et al. . | |
| 5,180,459 | 1/1993 | Bauer et al. . | |
| 5,205,307 | 4/1993 | Kuriki . | |
| 5,249,359 | 10/1993 | Schubert et al. . | |
| 5,323,849 | 6/1994 | Korczynski et al. | 165/158 |

FOREIGN PATENT DOCUMENTS

| | | | |
|---|---|---|---|
| 0 151213 | 8/1985 | European Pat. Off. . | |
| 0 468 904 A1 | 1/1992 | European Pat. Off. . | |
| 889916 | 1/1944 | France | 165/166 |
| 2 566 306 | 12/1985 | France . | |
| 483001 | 1/1970 | Germany . | |
| 63-267889 | 4/1988 | Japan . | |
| 2122738A | 1/1984 | United Kingdom | 165/166 |

OTHER PUBLICATIONS

Dennis E.G. Hills, Graphite Heat Exchangers–1, Dec. 23, 1974, Chemical Engineering, p. 80.

Dennis E.G. Hills, Graphite Heat Exchangers–II, Jan. 20, 1975, Chemical Engineering, p. 116.

*Primary Examiner*—Allen J. Flanigan

*Attorney, Agent, or Firm*—John R. Rafter

[57] ABSTRACT

A composite parallel plate heat exchanger is provided constructed of a plurality of composite plates disposed in a substantial parallel stacked relationship and spaced from each other by composite ribs inserted through and bonded between adjacent plates. The composite plates and ribs are specially constructed to maximize heat transfer between adjacent passageways formed by the plates and the fluids flowing in these passageways.

10 Claims, 1 Drawing Sheet

COMPOSITE PLATE PIN OR RIBBON HEAT EXCHANGER

This application is a division of application Ser. No. 08/463,609, filed Jun. 5, 1995.

This invention relates to heat exchangers and more particularly to heat exchangers constructed of a plurality of composite plates disposed in a substantial parallel stacked relationship and spaced from each other by composite pins or ribbons inserted through and bonded between adjacent plates. The composite plates and pins or ribbons are specially constructed to maximize heat transfer between adjacent passageways formed by the plates and the fluids flowing in these passageways.

CROSS REFERENCE TO RELATED APPLICATIONS

This application is related to copending application Ser. No. 08/422,207 for COMPOSITE MACHINED FIN HEAT EXCHANGER; copending application Ser. No. 08/422,335 for a COMPOSITE PARALLEL PLATE HEAT EXCHANGER; and copending application Ser. No. 422,334 for a COMPOSITE CONTINUOUS SHEET FIN HEAT EXCHANGER and copending application Ser. No. 422,208 for a CARBON/CARBON COMPOSITE PARALLEL PLATE HEAT EXCHANGER and METHOD OF FABRICATION filed on Apr. 13, 1995. These applications are assigned to the assignee hereof and the disclosures of these applications are incorporated by reference herein.

BACKGROUND

In two fluid, parallel plate heat exchangers constructed of metal parts, typically a hot fluid flows between first and second adjacent plates and transfers heat to the plates. This will be referred to as the hot passageway. A cold passageway, transverse or parallel to the hot passageway is constructed on the opposite side of the second plate. A second and cooler fluid flows in this passageway. These hot and cold passageways can be alternated to form a stacked array. Metal fins are provided between adjacent plates to assist the transfer of heat from the fluid in the hot passageway through the plate to the cold fluid in the second passageway. These fins are bonded to the plates providing extended heat transfer area and sufficient structural support to provide pressure containment of the fluids. To minimize flow blockage, the fins are disposed in parallel with the fluid flow and define a flow path with minimum additional flow resistance. In addition, the thickness and number of fins is such to provide a maximum heat transfer area in contact with the fluid. A thin fin satisfies these requirements and many different detailed geometry's are used to best satisfy the specific requirements of any given design problem.

Heretofore composite materials have been considered unavailable for these compact parallel plate heat exchangers. It has been considered impossible to achieve a composite fin which is sufficiently thin, sufficiently conductive and could be formed into an acceptable shape to be effective in transferring heat between the two fluids. Also, the fins must exhibit sufficient strength to support the stacked construction and provide pressure containment of the fluids.

SUMMARY OF THE PRESENT INVENTION

It is therefore an object of the present invention to provide composite pins or ribbons of specially constructed materials with a higher thermal conductivity than available metals to facilitate the transfer of heat between adjacent plates in parallel plate heat exchangers.

Another object of this invention is to employ composite material construction in a heat exchanger thereby providing an improved and lightweight heat exchanger. Specific conductivity (thermal conductivity/density) is a suitable figure of merit for materials used in heat exchanger construction. Aluminum has the highest specific conductivity of all conventional heat exchanger metals with a value of 81 watts per meter K/grams per cubic centimeter. Composite materials to be used in this invention have specific conductivity's 1.5 to 2.5 times higher than aluminum or approximately in the range of 121.5–202.5 watts per meter K/grams per cubic centimeter.

Another object of this invention is to use the greatly reduced coefficient of thermal expansion of these composite materials to reduce thermal stresses and provide prolonged operating life.

Another object of the invention is also directed at prolonging service life by the inherent improved corrosion resistance of composite materials.

Another object of the invention is to employ the potential anisotropic properties of composite materials to still further improve the transfer of heat within the heat exchanger.

In a preferred embodiment, a composite heat exchanger comprises first, second and third composite plates disposed in substantially parallel spaced relation, the first and second plates defining a first fluid flow passageway therebetween and the second and third plates defining a second fluid flow passageway therebetween. A plurality of composite ribs can be inserted through and bonded between said first, second, third plates supporting said plates in a stacked relation, and to conduct heat from said first passageway to said second passageway. An overall stacked array of alternating first and second passageways to form an integrated heat exchanger of sufficient size to accomplish the desired overall transfer of heat between the two flowing fluids. The composite material of the plates and ribs is selected from a class of materials comprising of a carbon fiber and polymeric resin matrix which provides improved performance and significantly reduced weight when compared to a conventional metal heat exchanger materials and a low coefficient of expansion and significantly reduces stress in the heat exchanger. The ribs can exhibit a cross sectional configurations selected form the class consisting of circular, linear, square, rectangular, triangular and diamond. The individual thermal conductance's and coefficients of the components are matched to either increase performance or reduce heat exchanger stress. The ribs preferably have a primary axis of thermal conductivity, as provided by an anisotropic material, that is substantially transverse to the plane of the plates.

In an alternate preferred embodiment, method of fabricating a composite heat exchanger in accordance with the present invention comprises the steps of: providing a plurality of substantially planar composite plates; providing a plurality of composite ribs; inserting the ribs in a transverse direction through the composite plates; separating the plates along the ribs to position the plates in spaced relation; and bonding the plates and ribs to fixedly position the ribs relative to the plates.

BRIEF DESCRIPTION OF THE DRAWINGS

These and other objects and features and advantages will become more apparent from the following detailed description of the invention shown in the accompanying drawing wherein the figures schematically show an enlarged pictorial view of the composite heat exchanger in accordance with the present invention.

DETAILED DESCRIPTION OF THE PREFERRED EMBODIMENTS

Figure 1:
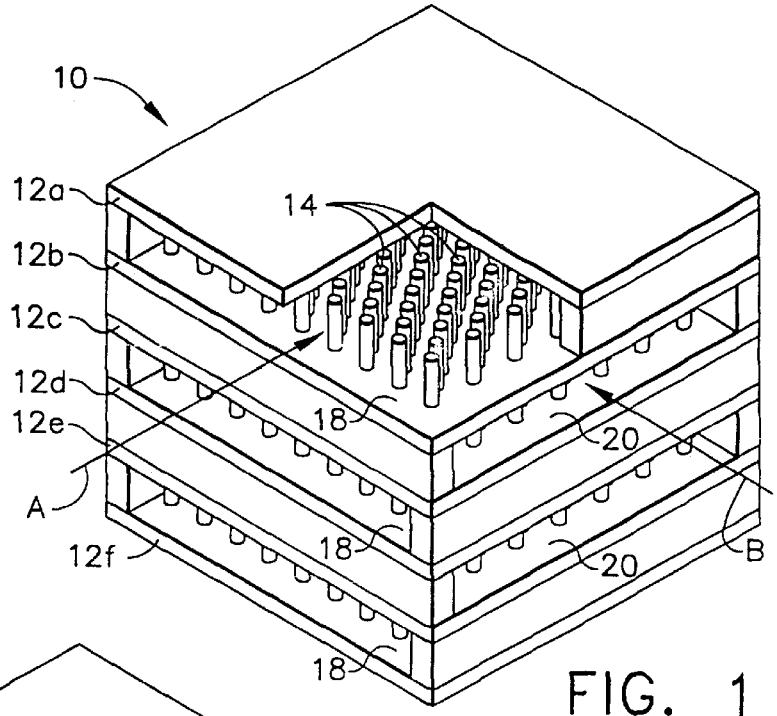
FIG. 1 is an illustration of a composite pin rib heat exchanger in accordance with this present invention and FIG. 2 is an illustration of a composite-ribbon rib heat exchanger in accordance with this present invention.

Referring now to the drawing, the heat exchanger 10 comprises a plurality of flat parallel plates 12*a*, 12*b*, 12*c*, 12*d*, 12*e* and 12*f* having preferably a rectangular shape and separated being from each other by a plurality of ribs 14 can be inserted through the plates 12 and bonded to the plates 12 proximate their intersection to ensure that the plates 12 and the ribs 14 remain fixedly positioned with respect to each other. The heat exchanger 10 preferably comprises an array of composite ribs is used to separate the composite parallel plates 12 and to transfer heat from one passageway to the other. In the preferred configuration the ribs 14 are continuous from one end of the stack of parallel plates to the other, thus providing the most direct heat flow path from passageway to passageway. The diameter and spacing of the ribs 14 can be varied together with the plate spacing to provide the best match to the desired total exchange of heat.

It is intended that fluids 22 and 24, such as air or any other fluid, flow between the plates 12 in alternating layers. Thus, a first fluid 22 can flow between plates 12*a* and 12*b* in the direction shown by arrow A while a second fluid 24 can flow between plates 12*b* and 12*c* in the direction shown by arrow B. The two passageways formed by the plates 12*a, b* and *c* are identified as the hot passageway 18 and the cold passageway 20 respectively. The second passageway 20 is most frequently oriented to facilitate the flow of the second fluid 24 transverse to the flow of the first fluid 22 in the first passageway 18. The first and second passageways 18 and 20 may also be oriented in parallel to provide the parallel flow stream arrangement of a counterflow heat exchanger. In this instance special provision must be added to assist the fluid entry and exit. In a preferred embodiment the plates 12 can be stacked to form an array of alternating first and second passageways 18 and 20 until the assembly as a whole provides the required heat transfer or exchange capability.

In FIG. 1 the heat exchanger 10 includes the plurality of ribs 14 separating the plates 12*a*, 12*b*, 12*c*, 12*d*, 12*e* and 12*f* from each other are configured as substantially cylindrical pins 14*a*. The pins 14 provide a smoothly contoured surface for positioning in the fluid flow to minimize surface obstruction to the fluid.

Figure 2:
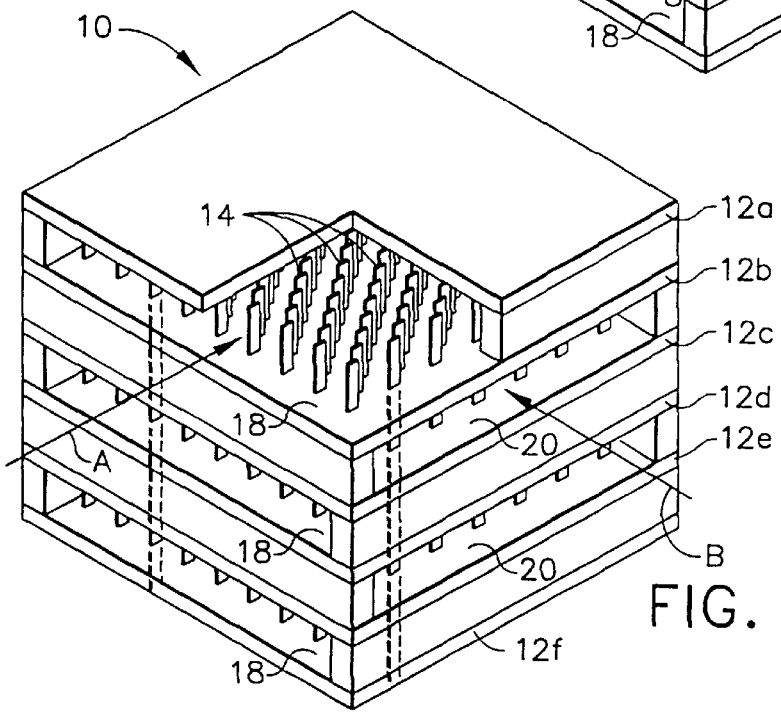

Referring now to FIG. 2, a heat exchanger 10 similar to that of FIG. 1 is shown wherein the ribs 14 are shown as a plurality of fins 14*b* which can be considered as an extreme case, of the pins flattened to form thin flat ribbons 14*b* as shown. The fins 14 preferably have a wide dimension in the direction of flow and narrow dimension transverse to the flow so that the ribbons are disposed in parallel with the fluid flow to define the flow path with the minimum resistance. It should however be noted that the inasmuch as the ribbons 13 are continuous through the complete stack of parallel plates 12, the minimum resistance flow path for the fluids 22 and 24 is only achieved if the two flow streams are in parallel as in a counter flow heat exchanger.

Where ribs 14 are used it is also possible to use transverse flow streams. If the flow 22 is parallel to the ribbons then the flow 24 will impinge directly on the flat faces of the ribbons in passageway 20. This provides a very high pressure differential in the flow 24 while maintaining the minimum resistance to the flow of the fluid 22. The angle between the plates 12 and ribs 14 may be set at any angle relative to the edge of the plates 12 and to the fluid streams 22 and 24 to provide a range of compromises in the resistance to the two fluid streams.

Figure 3:
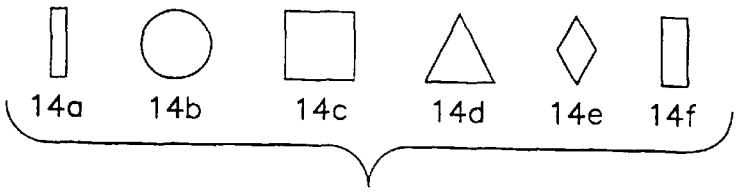
FIG. 3 is an illustration cross sectional views of various ribs.

In this invention the ribs 14 may also have other cross sectional shapes, such as those illustrated in FIG. 3 as a circular cross section 14*a,* a linear cross section 14*b,* a square cross section 14*c,* a triangular cross section 14*d,* a diamond cross section 14*e* or a rectangular cross section 14*f*. Many variations in rib cross section and spacing may be considered to best match the desired performance.

In operation, the first and second fluids 22 and 24 flowing in the first and second passageways 18 and 20 respectively are preferably at different temperatures to facilitate the heat transfer from one passage to the other. For instance the first fluid 22 can be hotter than the second fluid 24. When this hotter fluid 22 flows in the first passageway 18 heat is transferred from the fluid to the ribs 14 exposed in passageway 18 and to the plates 12*a* and 12*b*. Heat is then conducted through the ribs 14 the fluid 24 in the passageway 20. The second fluid 24 exits and flows from the heat exchanger 10 and carries the exchanged heat away from the heat exchanger 10 allowing the continuous flow of the hot fluid to be continuously cooled be the continuous flow of the cold fluid.

In accordance with the present invention the higher thermal conductivity of the composite material can be used to facilitate the heat transfer between the two fluids. The possible anisotropic nature of some composite materials can also be used to further enhance this transfer of heat. The lower density of the material can be used to reduce weight.

The two fluids in addition to the inherently unequal temperatures are at unequal pressures. The plates 12 must be of a thickness sufficient to provide structural integrity between fluid passages 18 and 20 but sufficiently thin to minimize weight and not interfere with the fluid flow but the rib 14 must have sufficient structural integrity and help keep the plates flat.

The plate thickness must be gaged to account for the fluid pressure difference between passageways 18 and 20 as this difference tends to bend the plates. The close spacing of the ribs results in small unsupported cross sectional areas of the plates 12. Therefore, the ribs 14 enhance structural integrity and help keep the plates flat.

The purpose of the heat exchanger is to transfer heat from one fluid to the other. Therefore if a hot fluid enters the passageway 18 as shown in the drawing, the inlet end of passage 18 is hotter than the exit end. Similarly, the cold fluid entering the passageway 20 is colder at the inlet and warmer at the exit. Thus, the corner of the heat exchanger where the hot fluid enters and the cold fluid exits 22 may be at a much higher temperature than the opposite corner 24 where the cold fluid enters and the hot fluid exits. This thermal gradient within the heat exchanger structure reduces the amount of heat which can be transferred. In metal heat exchangers the hot section expands much more than the cold section which sets up adverse stresses within the material and reduces heat exchanger life. Repeated cycling of temperatures caused by varying operating conditions and by turning flows off and on still further reduces strength and life by the repeated expansion and contraction of all parts of the heat exchanger.

A method of improving heat exchanger performance and extending life is to use the correct selection of composite materials. Fibers, used in the construction of composite materials, are presently available which have a wide range of thermal conductivity's. Additionally, composite materials may be anisotropic or isotropic dependent on how the fibers are oriented within the material. Isotropic materials conduct heat substantially uniformly along all three orthogonal axes X, Y and Z while anisotropic materials conduct heat predominantly along a first axis such as the Z-axis and to a lesser extent along the remaining two X and Y axes.

In the plate and rib heat exchanger of this invention high conductivity in the ribs 14 in the direction between the two plates 12 (the Z axis) is essential. Plate conductivity in this axis also affects performance but as the cross section area is large and the heat flow length is very short (plate thickness) this is much less important than the fin conductivity. By using a high conductivity anisotropic composite material for the ribs with the conduction path in the Z axis and a low conductivity anisotropic material for the plates, with the conductive plane oriented to minimize heat flow in the material from the hot corner to the cold corner, performance is maximized. An additional and very significant benefit in the use of composite materials is that the coefficient of expansion is also much lower than conventional heat exchanger metals and this greatly reduces thermal expansion and the resultant stresses.

In accordance with this invention, it is recognized that a number of different carbon fiber and polymeric resin composites, which may be either isotropic or anisotropic, can be selected to fabricate compact parallel plate heat exchangers such that the thermal flux exceeds the value which would be achieved with an identical heat exchanger fabricated from metal. Various other modifications may be contemplated by those skilled in the art without departing from the true spirit and scope of the present invention as here and after defined by the following claims. In addition to the fin geometry and flow configurations mentioned above, the heat exchangers could be formed in other than the illustrated rectangular shape; accordingly heat exchangers of cylindrical, circular or conical configuration are within the scope of the present invention.

What we claim as our invention is:

1. A method of fabricating a composite heat exchanger comprising the steps of:

providing a plurality of substantially planar high-strength fiber-matrix composite plates;

providing a plurality of high-strength fiber-matrix composite ribs;

inserting the ribs in a transverse direction through the composite plates; wherein the composite ribs and/or the composite plates comprise thermally conductive fibers oriented so as to impart an anisotropic thermal conductivity to the composite ribs and/or the composite plates;

separating the plates along the ribs to position the plates in spaced relation and thereby define first and second flow passageways therebetween; and bonding the plates and ribs to fixedly position the ribs relative to the plates whereby a free-standing composite heat exchanger structure is achieved.

2. The method of fabricating a composite heat exchanger of claim 1 wherein the composite material of the plates and ribs is selected from a class of materials comprising of a carbon fiber and polymeric resin matrix which provides improved performance and significantly reduced weight when compared to a conventional metal heat exchanger materials.

3. The method of fabricating a composite heat exchanger of claim 1 wherein the ribs exhibit a cross sectional configuration selected from the class consisting of circular, linear, square, rectangular, triangular and diamond.

4. The method of fabricating a composite heat exchanger of claim 1 wherein the selected composite material provides a low coefficient of expansion and significantly reduces stress in the heat exchanger.

5. The method of fabricating a composite heat exchanger of claim 1 wherein the individual thermal conductance's and coefficients of the components are matched to either increase performance or reduce heat exchanger stress.

6. The method of fabricating a composite heat exchanger of claim 1 wherein the composite materials exhibit high corrosion resistance and extend heat exchanger service life.

7. The method of fabricating a composite heat exchanger of claim 1 wherein the flow directions of the first and second passageways are transverse to each other.

8. The method of fabricating a composite heat exchanger of claim 1 where the flow directions of the first and second passageways are parallel to each other.

9. The method of fabricating a composite heat exchanger of claim 1 where the first and second passageways have a different plate spacings.

10. The method of fabricating a composite heat exchanger of claim 1 wherein the ribs having a primary axis of thermal conductivity, as provided by an anisotropic material, which is substantially transverse to the plane of the plates.

* * * * *